United States Patent [19]

Emerson

[11] 4,404,749

[45] Sep. 20, 1983

[54] COMBINATION TOOL APPARATUS

[75] Inventor: Clarence A. Emerson, Bozeman, Mont.

[73] Assignee: King Tool Inc., Bozeman, Mont.

[21] Appl. No.: 290,685

[22] Filed: Aug. 6, 1981

[51] Int. Cl.[3] ..... B26F 1/24

[52] U.S. Cl. ..... 30/164.9; 30/366

[58] Field of Search ..... 30/164.9, 322, 329, 30/358, 366

[56] References Cited

U.S. PATENT DOCUMENTS

| | | | |
|---|---|---|---|
| 1,541,078 | 6/1925 | Sudweeks | 30/366 |
| 2,492,921 | 12/1949 | Mandl | 51/170 PT |
| 2,847,758 | 8/1958 | Kozan | 30/164.9 |
| 2,885,780 | 5/1959 | Campbell | 30/164.9 |
| 3,080,653 | 3/1963 | Dolin | 30/329 X |
| 3,162,475 | 12/1964 | Van Allen | 30/322 |
| 3,797,112 | 5/1974 | Paulson | 30/366 |
| 4,316,326 | 2/1982 | Yeaton | 30/366 |

FOREIGN PATENT DOCUMENTS

| | | | |
|---|---|---|---|
| 16205 | of 1903 | United Kingdom | 30/366 |

*Primary Examiner*—Jimmy C. Peters
*Attorney, Agent, or Firm*—Arthur L. Urban

[57] ABSTRACT

Combination tool apparatus including a handle portion and a tool portion; the handle portion including an elongated handle member, the handle member including an opening extending into the member from one end thereof, the opening including an internal sidewall section, a gripping surface disposed along at least a portion of the outer surface of the handle member; the tool portion including a plurality of interchangeable pick members selectively connectable with the handle member, each of the pick members including a shank section, an external portion adjacent one end of the shank section mateable with the end opening in the handle member, the shank section including a gripping surface disposed along the length of the outer surface of the shank section adjacent to the external end portion thereof, a pick section extending from the end of the shank section opposite to the external end portion, the pick section including a pointed end portion extending from the free end of the pick member, one of the pick members including a pick section with a substantially straight configuration, another of the pick members including a pick section with a right angle configuration, a third of the pick members including a pick section with a hook configuration, a fourth of the pick members including a pick section with an ascending spiral configuration, the spiral configuration extending around an arc of less than 180°; whereby the external end portions of the pick members alternately may be inserted into the internal opening of the handle member to provide a picking tool.

5 Claims, 2 Drawing Figures

COMBINATION TOOL APPARATUS

Figure 1:
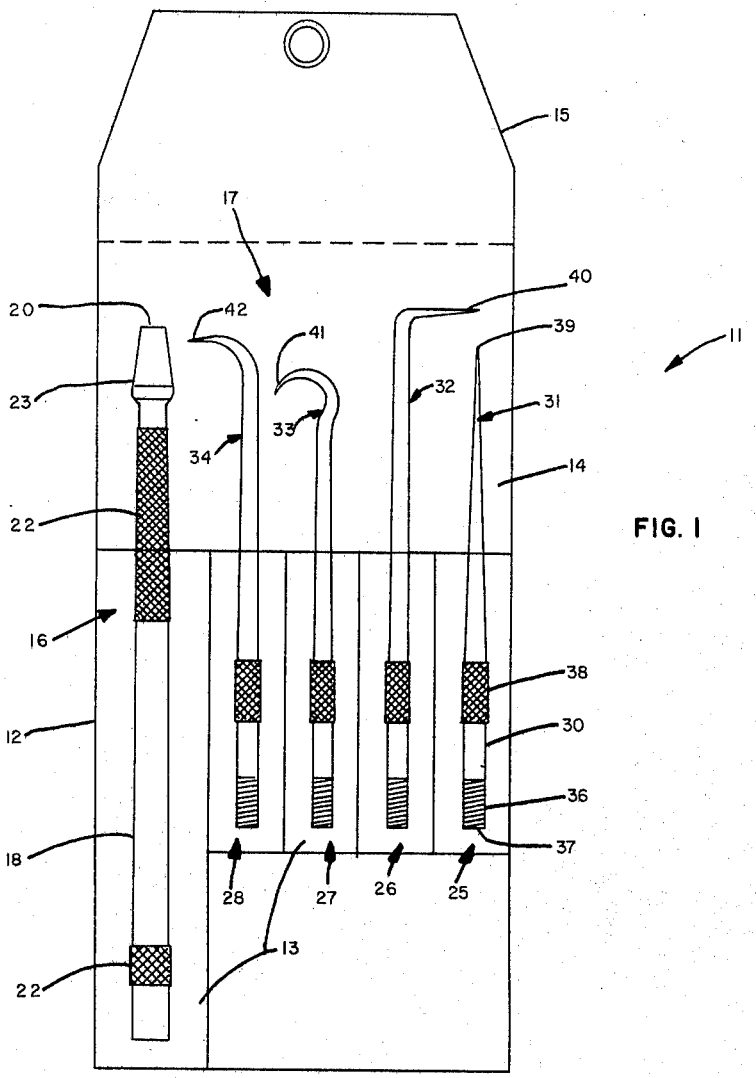

This invention relates to a novel tool and more particularly relates to a new tool apparatus including a number of combinable components.

Tools have been used by man for many, many centuries. These tools have taken a wide variety of different forms and shapes. Originally, man had to fashion tools from the raw materials close at hand. Tools were made of rock, stone, wood and the like. As man learned to use metals, parts of the tools that required the properties of metals were made from that material.

The industrial revolution created a great demand for tools that could be used in the fabrication and repair of the new machines. As a result, wrenches, drills and similar basic tools were developed.

Through the years, a wide variety of special tools also have been devised to facilitate the performing of certain tasks. While such special tools generally accomplish the task for which they were designed, they may create new problems. If a person wishes to purchase a large number of special tools, it will entail a considerable investment. Also, a large storage space must be provided for the many tools. In addition, the purchase of the special tools may not be justifiable if they are used only infrequently.

An alternative to the purchase of many different specialized tools is to improvise by using other tools or materials in a way that was not intended originally. Sometimes the desired results can be obtained even though it may be more difficult to perform the task. In other situations, it may not be possible to complete the desired task with makeshift tools and it still is necessary to purchase the special tool after losing valuable time in the first attempt.

Although there have been major efforts in the design and development of certain tools, other tools have received little if any attention. For example, a great number of different power tools have been offered. Also, a large variety of wrench sets are available.

Among the tools that have not changed significantly in recent years are tools such as markers, scribes, picks and the like. Even with such tools, however, many workmen have a number of each although they may differ only as to size. Again, with these tools, the expense and storage can present a problem the same as with specialized tools.

The present invention provides a novel combination tool apparatus which is capable of being used under a variety of conditions. The combination tool of the invention is relatively inexpensive as compared with the purchase of the several individual tools customarily required to do the same tasks. The apparatus of the invention can be stored conveniently in a small space, preferably in its own storage case. The use of the tool enables a workman to perform his job more efficiently so that he can do more work per day and thus can increase his income.

The combination tool apparatus of the present invention is simple in design and can be fabricated from commercially available materials and components. Conventional tool manufacturing techniques and procedures can be employed in its fabrication. The tool is durable in construction and does not require maintenance.

The combination tool apparatus of the invention can be used efficiently by workmen and even by those having limited experience and/or skills. The apparatus can be modified for different uses easily and quickly by persons with limited dexterity.

Figure 2:
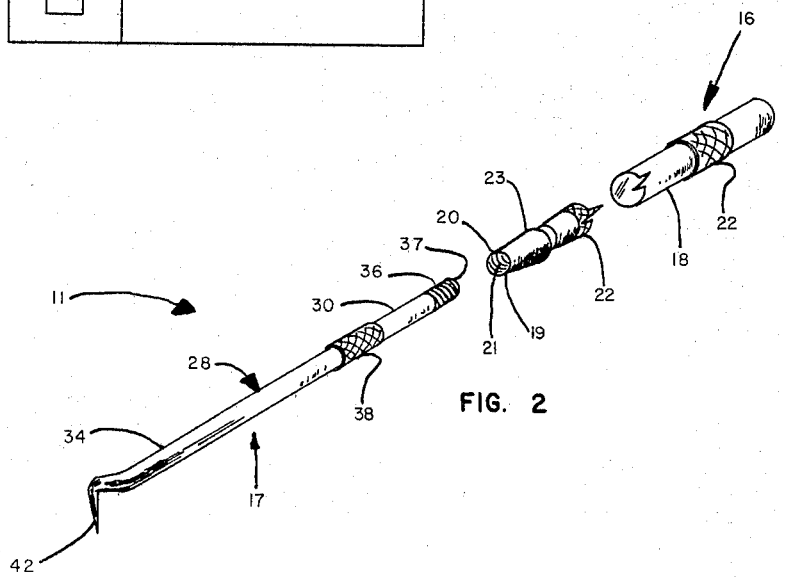

Other benefits and advantages of the novel combination tool apparatus of the present invention will be apparent from the following description and the accompanying drawings in which:

FIG. 1 is a side elevation of one form of the combination tool apparatus of the invention; and FIG. 2 is a view in perspective of one combination of the tool of the invention in separated form.

As shown in the drawings, one form of the novel combination tool apparatus 11 of the invention is stored in a case 12. The separated components advantageously are stored in a plurality of adjoining elongated pocket sections 13 in a substantially flat body section 14 with a flap section 15.

The combination tool apparatus 11 of the present invention includes a handle portion 16 and a tool portion 17. The handle portion 16 includes an elongated handle member 18. The handle member 18 includes an opening 19 extending into the member from one end 20 thereof. The opening 19 includes an internal sidewall section 21 which advantageously is threaded.

Gripping means are disposed along at least a portion of the outer surface of the handle member 18. Advantageously, the gripping means may be divided into a plurality of spaced gripping sections 22. In a preferred form of the tool 11 of the invention, the gripping means includes knurled sections as shown.

The handle member 18 advantageously has a generally cylindrical configuration with a length significantly longer than the tool portion 17. Preferably, the handle member 18 includes a tapered outer sidewall section 23 adjacent to the end 20 having opening 19 therein.

The tool portion 17 of the combination tool apparatus 11 of the invention includes a plurality of pick members 25, 26, 27 and 28. The pick members 25–28 are interchangeable and are selectively connectable with the handle member 18.

The pick members 25–28 each includes a similar shank section 30 with a different pick section 31, 32, 33 and 34, respectively. The shank section 30 includes an external portion 36 advantageously threaded adjacent one end 37 of the shank section. The shank section 30 includes gripping means 38 disposed along the length of the outer surface of the shank section. The gripping means 38 is disposed adjacent to the externally threaded end 37 of the shank section 30.

Each pick section 31–34 of the pick members 25–28 extends from the end of the shank section 30 opposite to the external end portion 36. Each pick section 31–34 includes a pointed end portion 39, 40, 41 and 42 of a different configuration from those of the other pick sections. The pointed end portions 39–42 extend from the free end of the respective pick member.

One of the pick members 25 includes a pick section 31 with a substantially straight configuration 39. Another of the pick members 26 includes a pick section 32 with a substantially right angle configuration 40. A third pick member 27 includes a pick section 33 with a hook or crook configuration 41. The fourth pick member 28 includes a pick section 34 with an ascending spiral configuration 42 shown in greater detail in FIG. 2. The spiral configuration 42 of pick section 34 extends around an arc of less than about 180°.

The combination tool apparatus 11 of the invention may be fabricated from a variety of materials such as metals, plastics, wood and the like. The handle portion 16 may be formed of wood or plastic or metal. Advantageously, the handle member 18 is formed of an aluminum rod with knurled gripping sections 22.

The pick members 25–28 generally are formed of a metal and preferably of tempered steel. This material provides a pick member with high strength and good resistance to deformation.

The carrying case 12 also may be fabricated from a large number of different materials including wood, plastic, metal and the like. The carrying case 12 advantageously includes separate compartments shown as adjoining pocket sections 13 with a separate pocket for each part of the tool apparatus 11, that is, for the handle member 18 and for each pick member 25–28. Preferably, the various members are arranged in the carrying case in substantially parallel compartments to minimize the space required for storage.

In the use of the tool apparatus 11 as shown in the drawings, the case 12 is opened to expose the various elements. Then, the handle member 18 is removed from its pocket as is one of the pick members 25–28. A particular pick member is selected to perform the required task. For example, for scribing or puncturing, pick member 25 may be desirable. On the other hand, for accessibility to recessed positions, one of the pick members 26–28 may be better.

After selecting the desired pick member and the handle member, the two components are aligned as shown in FIG. 2 with the opening 20 of the handle member 18 adjacent to the end portion 37 of the pick member. The end 37 then is inserted, preferably by threading, into the opening 20 until the handle member 18 and the pick member are securely affixed to each other. The tool 11 is now ready for use.

The tool apparatus 11 is used as a conventional one piece pick with a hand grasping the gripping means 22 of the handle member 18. When the task is completed or it is desired to change to a pick member of another different configuration, the pick member affixed to the handle member is withdrawn from the handle member and placed in the case. A new pick member is selected from the case 12 and the new pick member affixed to the handle member 18 in the same way as the first pick member. Upon completion of the task, the handle member and pick member are separated and the two components returned to their compartments in the case.

The above description and the accompanying drawings show that the present invention provides a novel combination tool apparatus that can be used under a variety of different conditions. Through the use of the novel tool of the invention, a workman may perform his job more efficiently. This enables the workman to do more work in a given period of time and thus increase his income.

The tool of the invention can be stored in a minimum of space, preferably in its own case. The tool is relatively inexpensive as compared with the several individual tools customarily required to do the same tasks.

The tool apparatus of the present invention is simple in design and can be fabricated from commercially available materials and components. Conventional tool manufacturing techniques and procedures can be employed in its fabrication. The tool is durable in construction and has a long useful life without maintenance.

The tool of the invention can be used efficiently and conveniently by workmen even by those having limited experience and/or skills. The apparatus can be modified easily and quickly even by persons with limited dexterity.

It will be apparent that various modifications can be made in the particular combination tool apparatus described in detail above and shown in the drawings within the scope of the invention. The size, configuration and arrangement of the pick members, handle member and case can be changed to meet specific requirements. Also, the number of pick members can be increased or decreased as desired. In addition, the means for connecting the pick members and handle member can be different, e.g., frictional engagement. These and other changes can be made in the tool apparatus provided the functioning and operation of the apparatus are not deleteriously affected. Therefore, the scope of the invention is to be limited only by the following claims.

What is claimed is:

1. Combination tool apparatus including a handle portion and a tool portion; said handle portion including an elongated handle member, said handle member having a generally cylindrical configuration, said handle member including an opening extending into said member from one end thereof, said opening including an internal sidewall section, gripping means disposed along at least a portion of the outer surface of said handle member; said tool portion including a plurality of interchangeable pick members selectively connectable with said handle member, said pick members and said handle member being mateable through threaded sections, each of said pick members including a shank section, an external portion adjacent one end of said shank section mateable with said end opening in said handle member, said shank section including gripping means disposed along the length of the outer surface of said shank section adjacent to said external end portion thereof, said gripping means on said handle member and said pick members including knurled sections, a pick section extending from the end of said shank section opposite to said external end portion, said pick section including a pointed end portion extending from the free end of said pick member, one of said pick members including a pick section with a substantially straight configuration, another of said pick members including a pick section with a right angle configuration, a third of said pick members including a pick section with a hook configuration, a fourth of said pick members including a pick section with an ascending spiral configuration, said spiral configuration extending around an arc of less than 180°, a storage case for said handle member and said pick members, said storage case including a substantially flat body portion with a plurality of adjoining elongated pocket sections; whereby the external end portions of said pick members alternately may be threaded into the internal opening of said handle member to provide a picking tool.

2. Combination tool apparatus according to claim 1 wherein said handle member includes a tapered outer sidewall section adjacent to the end thereof having said opening.

3. Combination tool apparatus according to claim 1 wherein said handle member includes a plurality of spaced gripping means disposed along the outside surface thereof.

4. Combination tool apparatus according to claim 1 wherein said pick members are formed of tempered steel.

5. Combination tool apparatus according to claim 1 wherein said handle member is formed of aluminum.

* * * * *